US008278579B2

(12) United States Patent
Lin et al.

(10) Patent No.: US 8,278,579 B2
(45) Date of Patent: Oct. 2, 2012

(54) THIN KEY STRUCTURE FOR KEYBOARDS/KEYPADS

(75) Inventors: Wen-Kuan Lin, Taipei (TW); Hsien-Ming Lin, Taipei County (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 256 days.

(21) Appl. No.: 12/692,024

(22) Filed: Jan. 22, 2010

(65) Prior Publication Data

US 2011/0005909 A1 Jan. 13, 2011

(30) Foreign Application Priority Data

Jul. 9, 2009 (CN) ..... 2009 1 0041099

(51) Int. Cl.
*H01H 13/70* (2006.01)

(52) U.S. Cl. ..... 200/345; 200/341

(58) Field of Classification Search ..... 200/517, 200/341, 344, 345; 400/490–496
See application file for complete search history.

(56) References Cited

U.S. PATENT DOCUMENTS

| | | | | |
|---|---|---|---|---|
| 5,907,612 | A * | 5/1999 | Aggus et al. | 379/368 |
| 6,121,564 | A * | 9/2000 | Huang | 200/345 |
| 6,171,003 | B1 * | 1/2001 | Lo | 400/495 |
| 6,204,462 | B1 * | 3/2001 | Huang | 200/345 |
| 6,242,705 | B1 * | 6/2001 | Huang | 200/520 |
| 6,969,815 | B1 * | 11/2005 | Lu | 200/345 |
| 7,462,796 | B1 * | 12/2008 | Chai | 200/341 |
| 2003/0150703 | A1 * | 8/2003 | Tsau | 200/345 |
| 2008/0023312 | A1 * | 1/2008 | Chin | 200/345 |
| 2009/0107821 | A1 * | 4/2009 | Ono | 200/341 |

* cited by examiner

*Primary Examiner* — Michael Friedhofer
(74) *Attorney, Agent, or Firm* — Li & Cai Intellectual Property (USA) Office

(57) ABSTRACT

A thin key structure includes a keycap, a key body, an elastic piece and a base. The keycap has a first side wall. The key body has a second side wall forming a hollow chamber in which the keycap can be put to connect the elastic piece. The inner of the second side wall is provided with guiding portions for guiding the keycap to move steadily in the key body. With the keycap being put in the key body, the total height of the key structure can be reduced, and the vertical moving distance of the keycap with respect to the key body to press the elastic piece can be shortened. Thus, the thin key structure can be made more compact.

9 Claims, 9 Drawing Sheets

THIN KEY STRUCTURE FOR KEYBOARDS/KEYPADS

BACKGROUND OF THE INVENTION

1. Field of the Invention

The present invention relates to a key structure, and in particular to a thin key structure capable of reducing the height of the key structure to facilitate steady operation at the important machine—human interface for data entry—the keyboard or keypad.

2. Description of Related Art

With the advancement of technology, electronic products such as personal computers, notebook computers and mobile phones are widely used in our daily life. Further, the range to which these electronic products can be applied becomes constantly larger. For easy carrying, electronic products are made to be more compact. As a result, it is an important issue for the manufacturers in this art to reduce the thickness of the keyboard associated with such compact electronic products as much as possible. FIG. 1 and FIG. 2 are exploded perspective views showing the conventional key structure from different viewing angles. The conventional key structure includes a base 10, an elastic piece 30 and a keycap 50. FIG. 3 is an assembled cross-sectional view showing the conventional key structure of FIGS. 1 and 2. FIG. 4 is a cross-sectional view showing that the key structure in FIG. 3 is pressed. The elastic piece 30 is disposed in the center of the back surface of the keycap 50. A plurality of posts 52 protruding from the back surface, under the key cap, of the keycap 50 are located to align with guiding holes 141 of the base 10. Guiding surfaces 1412 in the guiding holes 141 are used to guide the posts 52 to be inserted into the guiding holes 141. The posts 52 are brought into contact with ribs 1411 inside the guiding holes 141 respectively, while hooks 54 are engaged with engaging portions 142 of the base 10. As shown in FIG. 3, when the user presses a finger-pad, or pressing portion 51 of the keycap 50, each of the posts 52 moves along the rib 1411 inside the guiding hole 141 toward a body 11, so that the hooks 54 are not engaged with the engaging portion 142, thereby causing the abutting post 56 to move toward the body 11. As shown in FIG. 4, when the user release his finger and does not press the pressing portion 51, the elastic piece 30 pushes the abutting post 56 to cause the abutting post 56 to move reversely. In this way, each of the posts 52 can move reversely along the rib 1411 inside the guiding hole 141. Then, the hooks 54 are engaged with the engaging portions 142, thereby limiting the moving distance of the post 52 within the guiding hole 141. Thus, the keycap 50 can be prevented from escaping from the base 10.

However, the above-mentioned key structure has some problems as follows: (1) Since the keycap 50 is located above the base 10, the combination of the keycap 50 and the base 10 makes the total thickness of the key structure is at least the sum of thickness of the keycap 50 and the base 10. Thus, it is not easy to reduce the total thickness of the key structure. (2) The back surface of the keycap 50 is provided with four posts 52, two hooks 54, and an abutting portion 56. Accordingly, the base 10 has to be provided with four guiding holes 141 and two engaging portions 142. Each of these members is of a certain height and width, so that the whole key structure is complicated in construction. Thus, the friction forces among these members and the time for assembling the key structure are increased inevitably, which does not conform to the tendency toward the miniaturization of the key structure. (3) When the user intends to press the keycap 50, the user has to overcome the friction force between the keycap 50 and the base 10, so that the user has to apply a larger force to press the keycap 50 completely, which does not conform to the requirement for ergonomics. Therefore, it is an important issue for the manufacturers in this art to develop a keyboard for easy assembly and use.

In view of the above, the present Inventor proposes a thin key structure capable of reducing the total thickness and weight of the key structure, whereby the key structure becomes more compact and user-friendly to generate a steady operation.

SUMMARY OF THE INVENTION

The objective of the present invention is to provide a thin, responsive key structure with a simple construction, thereby reducing the total height of the key structure and shortening the moving distance of the keycap with a lower force required from operator fingers. Thus, a new type of keyboard may be made in a more compact fashion.

The present invention provides a thin key structure, which includes a keycap having a finger-touch pad or pressing surface, an abutting post protruding from the pressing surface, and a first side wall extending along a periphery of the pressing surface, the first side wall surrounding the pressing surface to form a hollow space in which the abutting post is located; a key body having a second side wall, the second side wall surrounding to form a hollow chamber, the first side wall of the key cap being put in the hollow chamber, an inner of the second side wall being provided with at least two guiding portions symmetrically opposed about the center with each other to correspond to the first side wall; and an elastic piece located in the hollow chamber of the key body and located on a base, one end of the elastic piece contacting the abutting post for bearing a pressure from the keycap and providing a restoring force for the keycap to return to it's normal inactive position.

One of the features of the present invention is that the guiding portions are a pair of vertical guiding posts.

One of the features of the present invention is that the guiding portions are a guiding post and a guiding slot both oriented vertically and mated with each other.

According to one embodiment of the present invention, the hollow chamber of the second side wall is provided with first chamfered corners. The guiding posts are located on the second side wall on both sides of the first chamfered corners respectively. The first side wall is provided with second chamfered corners. The second chamfered corners, the first chamfered corners and the guiding posts together guide the vertical movement of the keycap.

According to another embodiment of the present invention, the hollow chamber of the second side wall is provided with first chamfered corners. The guiding slots are located on the second side wall on both sides of the first chamfered corners respectively. The first side wall is provided with second chamfered corners. The second chamfered corners are provided with guiding posts at the positions corresponding to those of the guiding slots respectively. The guiding posts are restricted in the guiding slots respectively, and both of them are used to guide the movement of the keycap.

According to another embodiment of the present invention, the hollow chamber of the second side wall is provided with first chamfered corners. The guiding post is located on the second side wall on both sides of the first chamfered corners respectively. The first side wall is provided with second chamfered corners. The second chamfered corners are provided with guiding slots at the positions corresponding to those of the guiding posts respectively. The guiding posts are restricted in the guiding slots respectively, and both of them are used to guide the movement of the keycap.

Further, the present invention is provided with a locking notch on the second side wall. The first side wall of the keycap is provided with a hook for mating with the locking notch. When the keycap moves in the vertical direction, the hook is restricted by the locking notch in the vertical direction, thereby guiding the keycap to operate steadily and preventing the keycap from escaping from the hollow chamber of the key body.

In comparison with prior art, the present invention has advantageous features as follows:

(1) The total height of the key structure is reduced greatly. The keycap extends to form a first side wall along the periphery of the pressing surface, so that the first side wall surrounds the pressing surface to form a hollow space. The abutting post is located in the hollow space, and the first side wall is put into the hollow chamber of the second side wall of the key body with the abutting post being connected to the elastic piece. In this way, the whole key structure is simple in construction, and the total thickness is smaller than the sum of the thickness of the keycap and the key body.

(2) A steady vertical movement can be achieved. The second side wall of the key body is provided with at least two guiding portions symmetric with each other. The guiding portions cooperate with the first and second chamfered corners of the key body to guide the vertical movement of the keycap more steadily. Further, the cooperation between the hook and locking notch can not only increase the tightness between the keycap and the key body, but also guarantee the steady vertical movement of the keycap in the hollow chamber of the key body.

(3) The length of exerting a force is reduced. The combination of the keycap and the key body reduces the distance between the keycap and the elastic piece, and thus reduces the distance of the vertical movement of the keycap. The guiding portion only acts to guide the movement of the keycap, but not generates any resistance to the keycap. Thus, the force necessary for pressing the keycap becomes smaller. As a result, the key structure of the present invention can be pressed more easily and conforms to the requirements for a compact design.

In order to further understand the characteristics and technical contents of the present invention, a description relating thereto will be made with reference to the accompanying drawings. However, the drawings are illustrative only but not used to limit the present invention.

DETAILED DESCRIPTION OF THE PREFERRED EMBODIMENTS

The aforesaid and other technical contents, features and effects of the present invention will be explained in detail with reference to the description of a preferred embodiment and the accompanying drawings.

Figure 1:
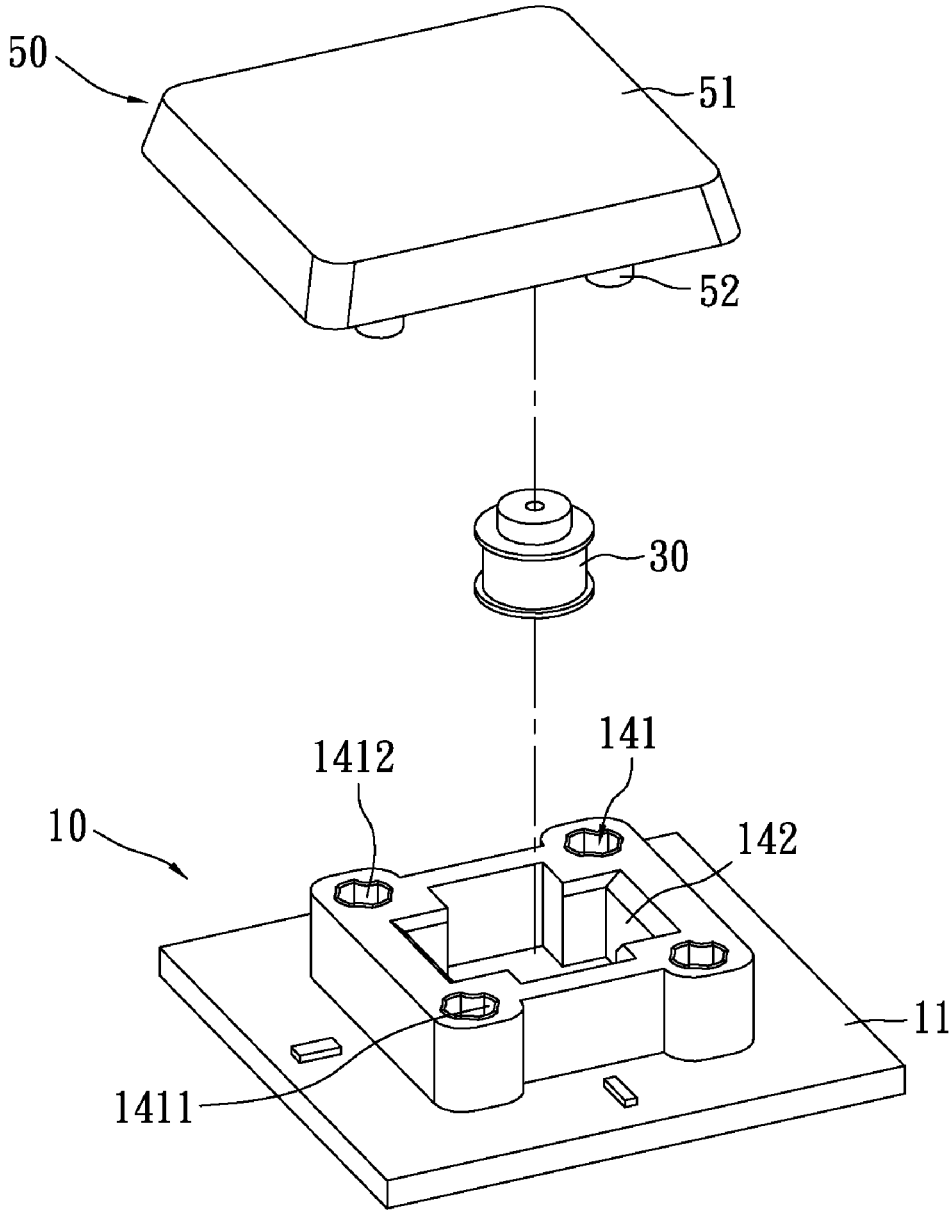
FIG. 1 PRIOR ART
FIGS. 1 and 2 are exploded perspective view showing the conventional key structure in different viewing angles.
Figure 2:
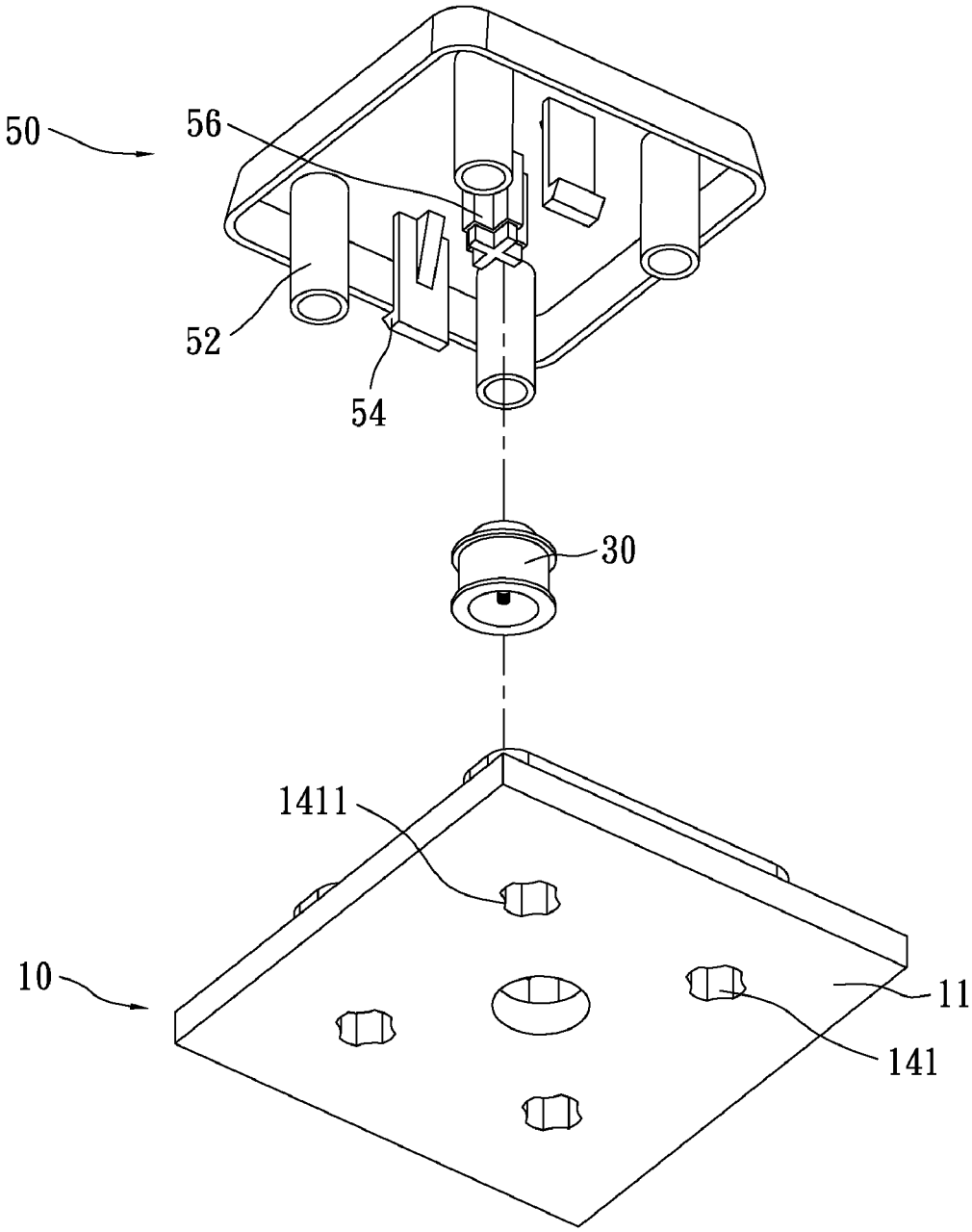
FIG. 2 PRIOR ART
Figure 3:
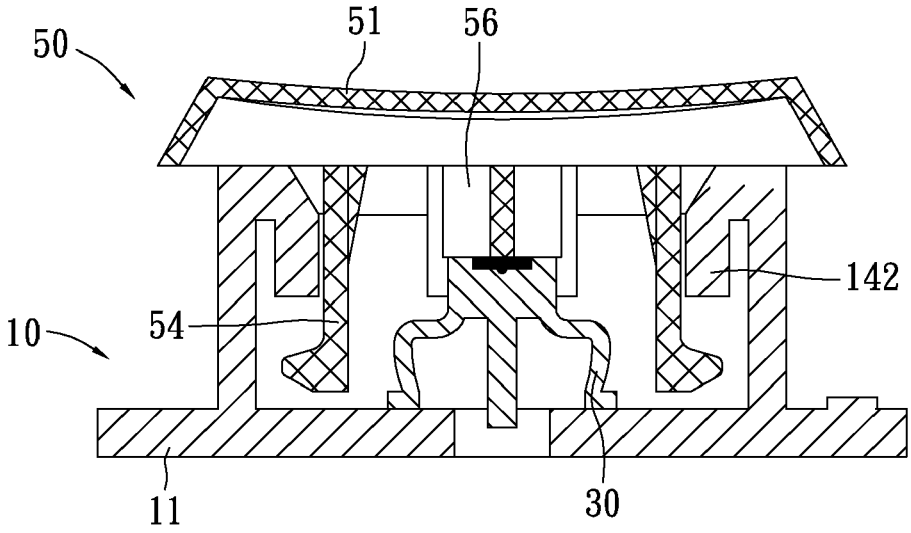
FIG. 3 PRIOR ART
FIG. 3 is an assembled cross-sectional view showing the conventional key structure in FIGS. 1 and 2.
Figure 4:
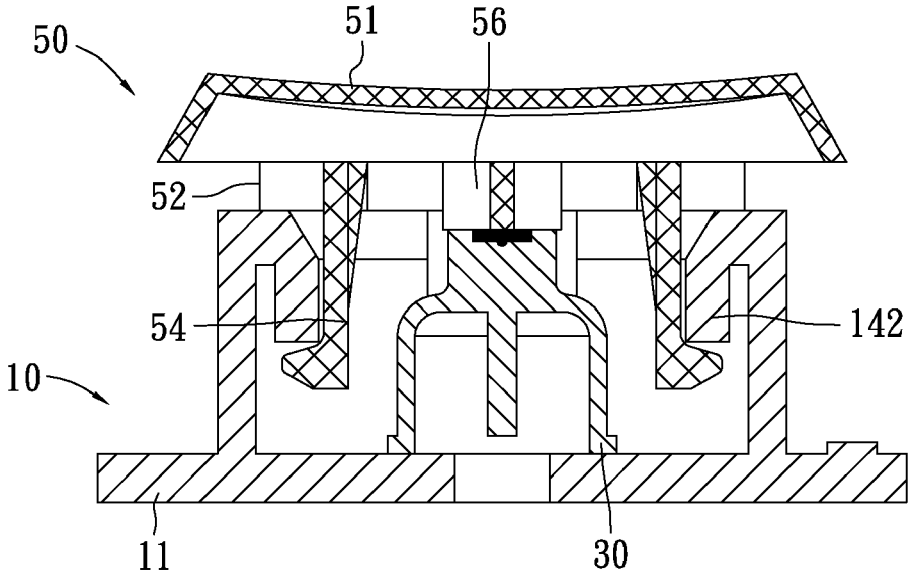
FIG. 4 PRIOR ART
FIG. 4 is a cross-sectional view showing that the key structure in FIG. 3 is pressed.
Figure 5:
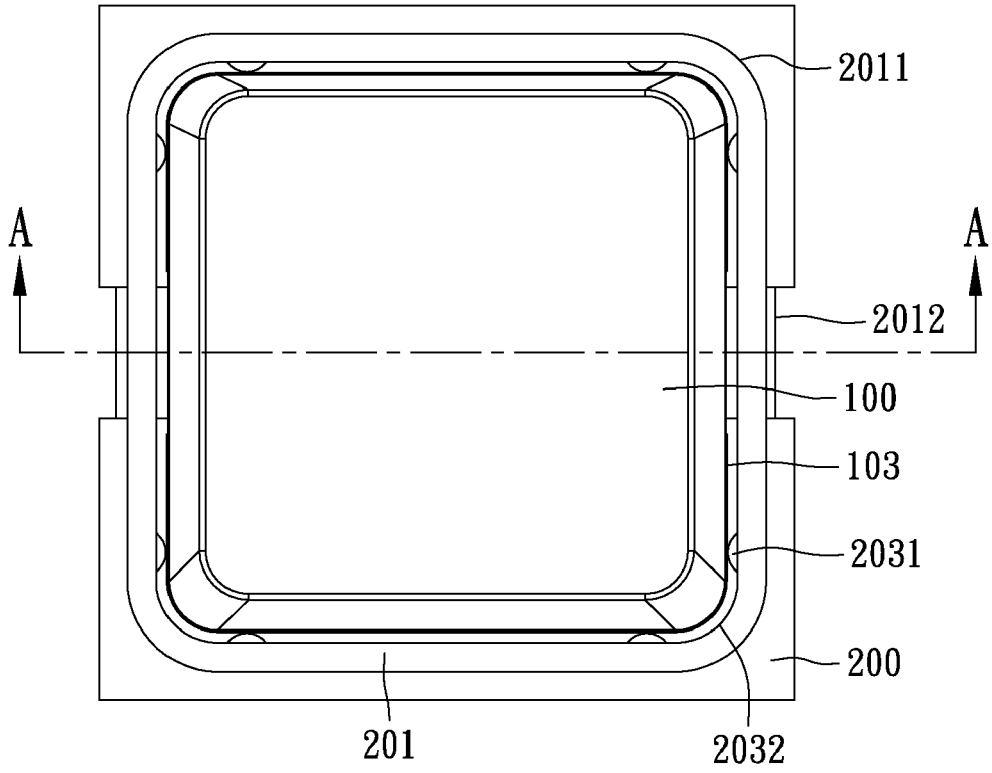
FIG. 5 is a top view showing the thin key structure according to the first embodiment of the present invention.
Figure 6:
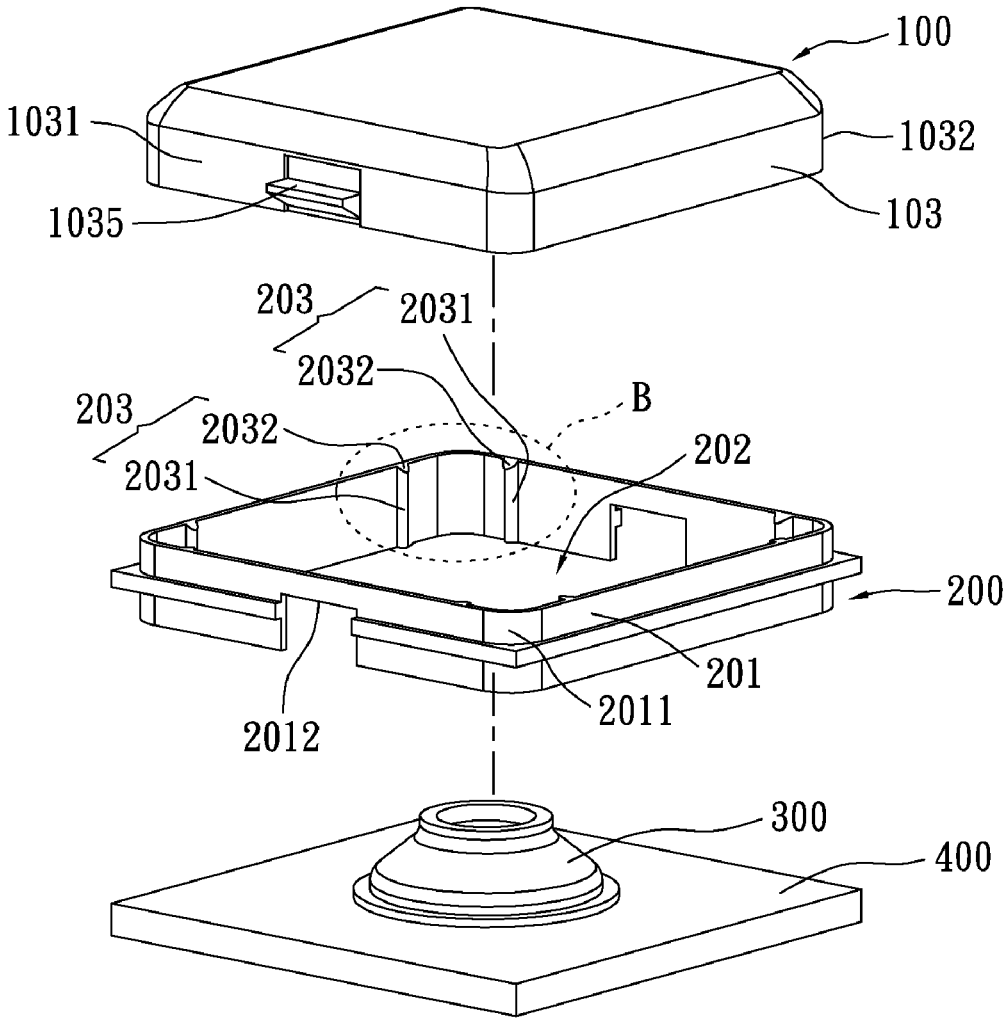
FIG. 6 is an exploded perspective view showing the thin key structure of the present invention.
Figure 8:
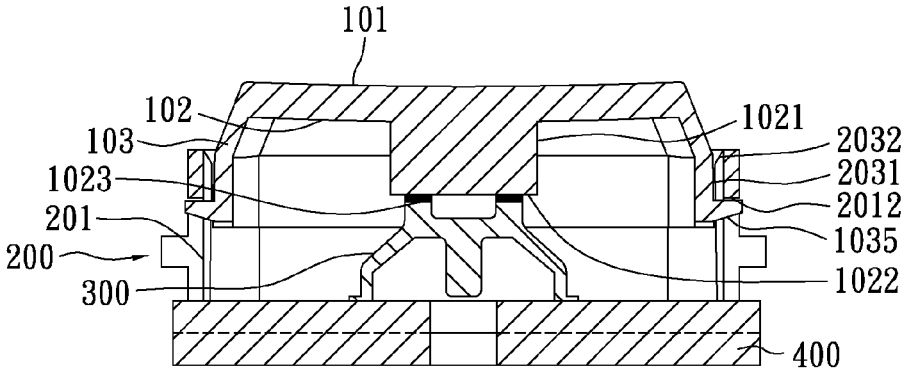
FIG. 8 is a cross-sectional view taken along the line A-A in FIG. 5.

FIG. 5 is a top view showing the thin key structure according to the first embodiment of the present invention. FIG. 6 is an exploded perspective view showing the thin key structure of the present invention. FIG. 8 is a cross-sectional view taken along the line A-A in FIG. 5. Please refer to FIGS. 5, 6 and 8. The thin key structure of the present invention includes a keycap 100, a key body 200, an elastic piece 300 and a base 400.

The keycap 100 has a pressing surface 101 (i.e., finger-touch pad) on which the user presses, an inner concave 102 and a first side wall 103 extending downwards from the periphery of the pressing surface 101. The first side wall 103 surrounds to form an annular body 1031. The key body 200 has a second side wall 201. The second side wall 201 surrounds to form a hollow chamber 202. The hollow chamber 202 allows the hollow annular body 1031 of the keycap 100 to be disposed therein. The elastic piece 300 can be received in the center of the hollow chamber 202 of the key body 200 with the upper edge of the elastic piece 300 connecting to the keycap 100. When the keycap 100 is pressed, the elastic piece 300 is deformed due to a vertical downward force exerted by the keycap 100, thereby generating a vertical restoring force. According to the present invention, since the keycap 100 can be put into the key body 200, and the annular body 1031 of the first side wall 103 of the keycap 100 is restricted in the hollow chamber 202 of the key body 200, the total height of the key structure is smaller than the sum of the heights of the keycap 100 and the key body 200. Accordingly, the vertical moving distance of the keycap 100 with respect to the key body 200 to press the elastic piece 300 is reduced, thereby achieving a thin key structure.

The base 400 is used to support the above-mentioned members, and it includes a seat, an electrical conductive film or the like. The key body 200 is fixed to the base 400. The elastic piece 300 is received in the hollow chamber 202 of the key body 200. The lower end of the elastic piece 300 is fixed to the base 400, and the other upper end of the elastic piece 300 is brought into contact with the keycap 100. Most preferably, the elastic piece 300 is provided in the center of the hollow chamber 202 and fixed to the center of the base 400, so that the elastic piece 300 can move with respect to the base 400 steadily. The fixation between the base 400 and the key body 200 as well as the fixation between the base 400 and the elastic piece 300 can be carried out by binding or other manners. Please refer to FIGS. 6 and 8. The center of the inner concave 102 of the keycap 100 is provided with an abutting post 1021. The free end of the abutting post 1021 is an abutting portion 1022. The center of the abutting portion 1022 is provided with a boss 1023. The keycap 100 is connected to the elastic piece 300 by means of the abutting portion 1022. In the present embodiment, the keycap 100 is substantially formed into a rectangular post, while the hollow annular body 1031 is also formed into a rectangular post. The four corners of the rectangular post are provided with second chamfered corners 1032 respectively. The aforesaid rectangular post is just used as an example. The present invention is not limited to any specific form, and can be changed depending on the practical demands.

Figure 7:
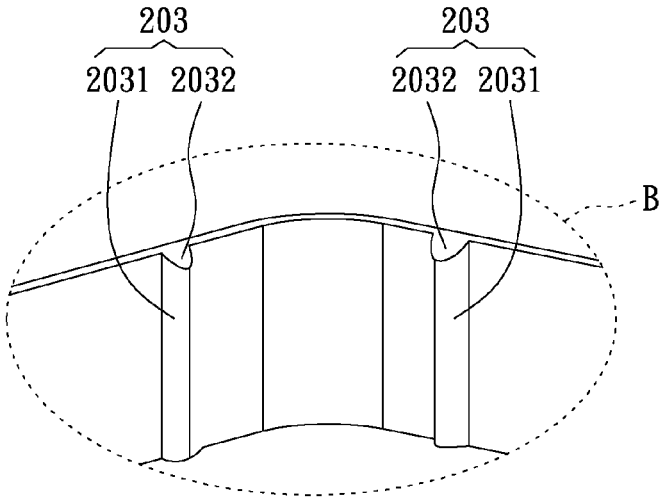
FIG. 7 is an enlarged view of the portion B in FIG. 6.

FIG. 7 is an enlarged view showing the portion B in FIG. 6. Please refer to FIG. 7. The construction of the key body 200 is further described. The shape of the key body 200 is similar to that of the keycap 100 (i.e. a rectangular post). Four corners of the key body 200 shaped as a rectangular post are provided with first chamfered corners 2011. The positions of the first chamfered corners 2011 correspond to those of the second chamfered corners 1032. The inner of the hollow chamber 202 of the key body 200 is provided with at least two guiding portions 203 symmetric with each other in position. In the present embodiment, the inner of the hollow chamber 202 is provided with the guiding portions 203 adjacent to four corners. Both sides of the first chamfered corner 2011 are provided with a guiding portion 203 respectively. Each of the guiding portions 203 has a vertical guiding post 2031 provided on the inner of the second side wall 201. By this arrangement, the guiding posts 2031 and the first chamfered corner 2011 cooperate to guide the keycap 100 to move vertically with respect to the key body 200, so that the keycap 100 can be restricted by the pairs of guiding posts 2031 of the guiding portions 203 without affecting the pressing of the keycap 100 (FIG. 8). Thus, the keycap 100 can move steadily in the vertical direction. Further, the upper edge of the guiding post 2031 is designed to have a slope 2032. The slope 2032 allows the first side wall 1031 of the keycap 100 to slide into the hollow chamber 202 smoothly. The number and construction of the guiding portion 203 in the present embodiment are used as an example. The present invention is not limited to this, and can be changed depending on the practical demands.

It should be noted that, the keycap 100 is put into the key body 200, and the annular body 1031 of the first side wall 103 of the keycap 100 is restricted in the hollow chamber 202 of the key body 200 to move vertically. The periphery of the annular body 1031 of the keycap 100 is slightly smaller than the inner periphery of the hollow chamber 202 of the key body 200. Further, the sum of heights of the annular body 1031 and the elastic piece 300 is slightly smaller than the height of the hollow chamber 202 of the key body 200. By this arrangement, the total height of the key structure can be reduced greatly, and the vertical moving distance of the keycap 100 with respect to the key body 200 to press the elastic piece 300 is shortened. Therefore, a thin key structure can be made more compact, and the present invention can be pressed easily with a smaller force.

According to the present invention, the first side wall 103 of the keycap 100 is provided with a hook 1035 which is a hook curving outwards. The second side wall 201 of the key body 200 is provided with a locking notch 2012 corresponding to the hook 1035 and penetrating the second side wall 201. In FIG. 6, the locking notch 2012 is a through-hole of a suitable length. Of course, the locking notch 2012 may be a trough (not shown) of a suitable length provided on the inner of the second side wall 201. When the hook 1035 is engaged in the locking notch 2012, the level of the keycap 100 located in the key body 200 can be restricted. Moreover, the hook 1035 manipulatably passes through the locking notch 2012 and exposed out of the second side wall 201. With the guidance and cooperation of the hook 1035 and the locking notch 2012, the vertical movement of the keycap 100 can be steadier. Further, the keycap 100 and the key body 200 can be connected with each other more firmly, thereby preventing the keycap 100 from escaping from the hollow chamber 202 of the key body 200.

The elastic piece 300, the base 400 and the assembly thereof belong to prior art, and thus the description thereof is omitted for clarity. Thus, in the following, the description will be focused on the way of mounting the keycap 100 and the key body 200. When mounting the thin key structure, the elastic piece 300 is fixed to the center of the base 400. Then, the fixed elastic piece 300 penetrates the hollow chamber 202 of the key body 200. At this time, the elastic piece 300 is located exactly in the center of the hollow chamber 202. Next, the second chamfered corners 1032 of the keycap 100 are aligned with the first chamfered corners 2011 of the key body 200 respectively, and the hook 1035 is aligned with the locking notch 2012. When the keycap 100 is put vertically into the hollow chamber 202 of the key body 200, the keycap 100 can be guided by the slopes 2032 on the top of the guiding posts 2031. In this way, the first side wall 103 of the keycap 100 is restricted in the guiding posts 2031 (FIG. 8), and the hook 1035 is engaged in the locking notch 2012. Further, the keycap 100 is lifted by the elastic piece 300, so that the hook 1035 is located at a higher position in the locking notch 2012 (FIG. 8).

Figure 9:
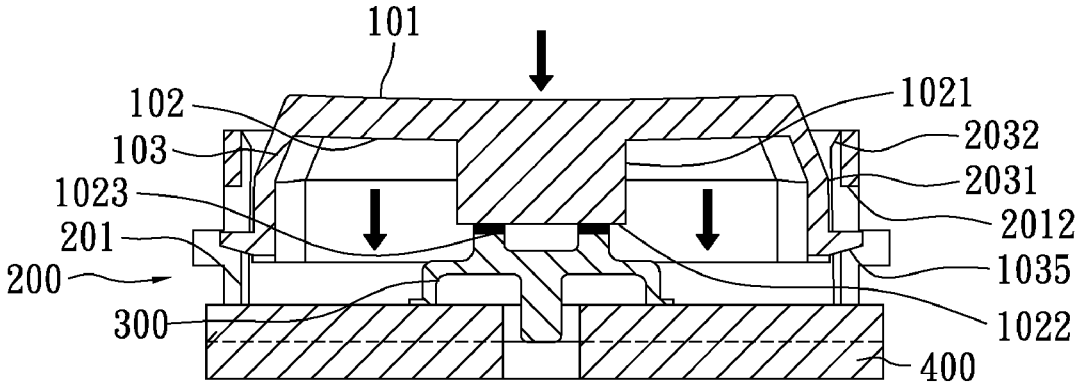
FIG. 9 is a schematic view showing that the key structure of FIG. 8 is pressed.

Please refer to FIG. 9. When any point of the pressing surface 101 of the keycap 100 is subjected to a force to cause the keycap 100 to move downwards with respect to the key body 200, the first side wall 103 is guided by the guiding posts 203 and the hook 1035 is restricted to move to the lowest point in the locking notch 2012. As a result, the keycap 100 can press the elastic piece 300 steadily while the boss 1023 is brought into contact with the center of the elastic piece 300 to generate a control signal. On the contrary, when the force exerted on the pressing surface 101 is released, that is, the force exerting to the elastic piece 300 is released, the keycap 100 moves upwards due to the restoring force generated by the elastic piece 300. Since the first side wall 103 is restricted in the guiding posts 2031 and the hook 1035 moves to the highest point in the locking notch 2012, the keycap 100 can move upwards with respect to the key body 100 steadily.

In practice, the keycap 100 can be formed into a cylinder, a rectangular post or other shape. The shape of the key body 200 can be changed according to the shape of the keycap 100. In the second embodiment, a further post may be provided in the keycap 100, thereby guiding the key body 200.

Figure 10:
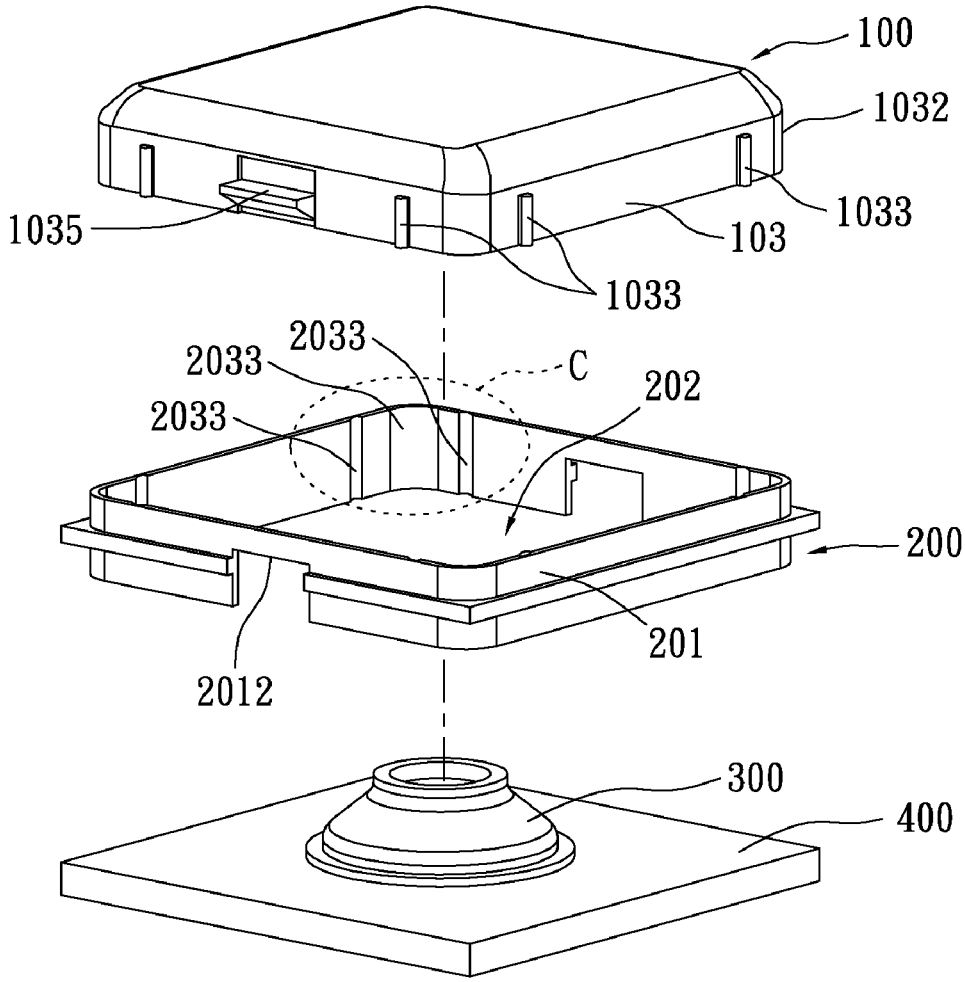
FIG. 10 is an exploded perspective view showing the thin key structure according to the second embodiment of the present invention.
Figure 11:
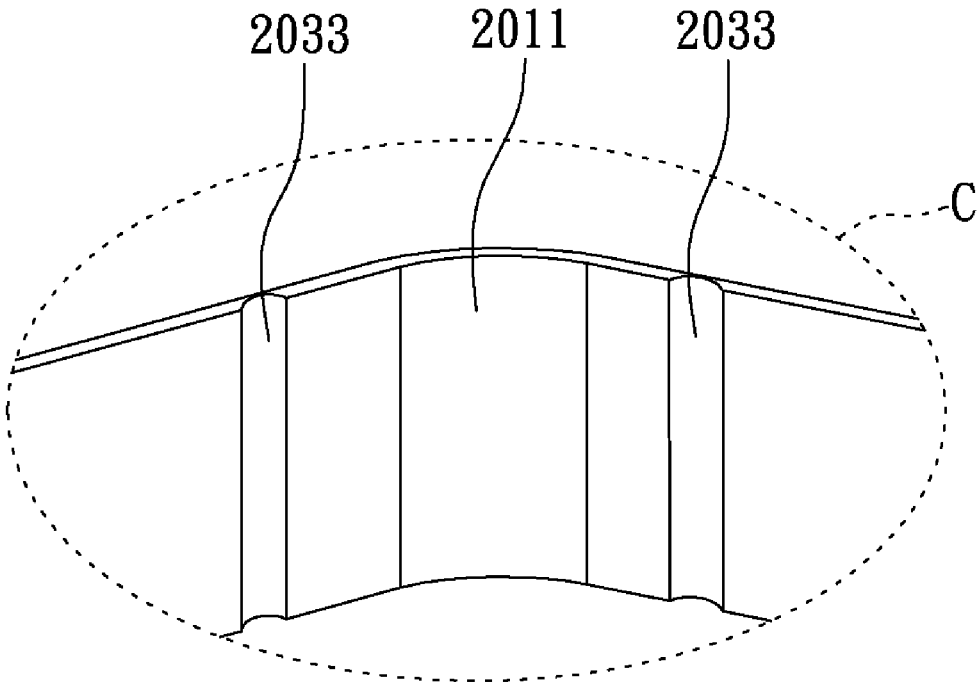
FIG. 11 is an enlarged view of the portion C in FIG. 10.

FIG. 10 is an exploded perspective view showing the thin key structure according to the second embodiment of the present invention. FIG. 11 is an enlarged view showing the portion C in FIG. 10. In the present embodiment, the keycap 100 and the key body 200 are still a rectangular post respectively. However, the keycap 100 and the key body 200 can be formed into a cylinder or other shape. The difference from the previous embodiment lies in that: the guiding portions 203 of the present embodiment are provided on the inner of the second side wall 201 of the key body 200 adjacent to the corners. Each of the guiding portions 203 is located on both sides of the first chamfered corner 2011. Further, the inner of the two adjacent second side walls 201 are provided with a vertical guiding slot 2033 respectively. The outer wall of the two first side walls 103 adjacent to the second chamfered corner 1032 are provided with vertical guiding posts 1033 to correspond to the guiding slots 2033. With the cooperation of the guiding slots 2033 and the guiding posts 1033 together with the chamfered corners, the keycap 100 can be guided to move vertically with respect to the key body 200 steadily. Of course, the positions of the guiding slots and the guiding posts can be exchanged. That is, the guiding slots 2033 are located on the outer wall of the first side wall 103, while the guiding posts 1033 are located on the inner of the second side wall 201. In other words, the guiding portion 203 of the present embodiment is constituted of the guiding posts 1033 or constituted of the guiding slots 2033 and the guiding posts 1033.

According to the above, in the thin key structure of the present invention, the keycap is put into the key body. Thus, when the keycap is pressed, the first side wall of the keycap is guided to move vertically in the key body, which reduces the total height of the key structure. Further, by the guiding portions provided on the second side wall of the key body, the keycap can move more steadily. Also, the vertical moving distance of the keycap with respect to the key body to press the elastic piece can be shortened. Thus, the thin key structure can be made more compact.

The above-mentioned descriptions represent merely the preferred embodiments of the present invention, without any intention to limit the scope of the present invention thereto. Various equivalent changes, alternations or modifications based on the claims of present invention are all consequently viewed as being embraced by the scope of the present invention.

What is claimed is:

1. A thin key structure, comprising:

a keycap having an abutting post, a pressing surface arranged opposite to the abutting post, and a first side wall extending along a periphery of the pressing surface, the first side wall surrounding the pressing surface to form a hollow space, the abutting post being located in the hollow space, wherein the first side wall of the keycap is provided with a hook;

a key body having a second side wall surroundingly forming a hollow chamber, the first side wall of the keycap being put in the hollow chamber, an inner of the second side wall being provided with at least two guiding portions symmetric with each other to correspond to the first side wall, wherein the second side wall is provided with a locking notch penetrating the second side wall, and the hook manipulatably passes through the locking notch and exposed out of the second side wall;

a base for allowing the key body to be provided thereon; and an elastic piece located in the hollow chamber of the key body, one end of the elastic piece being fixed to the base, the other end of the elastic piece being brought into contact with the abutting post for bearing a pressure from the keycap and providing a restoring force for the keycap.

2. The thin key structure according to claim 1, wherein the guiding portions are vertical guiding posts.

3. The thin key structure according to claim 2, wherein an upper edge of the guiding post is further provided with a slope.

4. The thin key structure according to claim 3, wherein the second side wall is provided with first chamfered corners, the guiding posts are provided on the second side wall on both sides of the first chamfered corners respectively, the first side wall is provided with second chamfered corners, the second chamfered corners, the first chamfered corners and the guiding posts together guide the movement of the keycap.

5. The thin key structure according to claim 1, wherein the guiding portions are guiding posts and guiding slots oriented vertically and mated with each other.

6. The thin key structure according to claim 5, wherein the second side wall is provided with first chamfered corners, the guiding slots are provided on the second side wall on both sides of the first chamfered corners, the first side wall is provided with second chamfered corners, the first side wall is provided with guiding posts on both sides of the second chamfered corners to correspond to the guiding slots respectively, the guiding posts are restricted in the guiding slots to guide the movement of the keycap.

7. The thin key structure according to claim 5, wherein the second side wall is provided with first chamfered corners, the guiding posts are provided on the second side wall on both sides of the first chamfered corners, the first side wall is provided with second chamfered corners, the first side wall is provided with guiding slots on both sides of the second chamfered corners to correspond to the guiding posts respectively, the guiding posts are restricted in the guiding slots to guide the movement of the keycap.

8. The thin key structure according to claim 1, wherein the hook cooperates with the locking notch to make the keycap to move steadily.

9. The thin key structure according to claim 1, wherein the key body is fixed to the base, the elastic piece is provided in the hollow chamber of the key body, a lower end of the elastic piece is fixed to the base, and the other upper end thereof is brought into contact with the keycap.

* * * * *